US008816582B2

(12) United States Patent
Nützel et al.

(10) Patent No.: US 8,816,582 B2
(45) Date of Patent: Aug. 26, 2014

(54) PHOTO CATHODE FOR USE IN A VACUUM TUBE AS WELL AS SUCH AS VACUUM TUBE

(75) Inventors: Gert Nützel, Brive la Gaillarde (FR); Pascal Lavoute, Brive la Gaillarde (FR); Christophe Fontaine, Brive la Gaillarde (FR); Richard Jackman, Brive la Gaillarde (FR)

(73) Assignee: Photonis France SAS (FR)

( * ) Notice: Subject to any disclaimer, the term of this patent is extended or adjusted under 35 U.S.C. 154(b) by 0 days.

(21) Appl. No.: 13/634,305

(22) PCT Filed: Mar. 11, 2011

(86) PCT No.: PCT/NL2011/050165

§ 371 (c)(1),
(2), (4) Date: Feb. 13, 2013

(87) PCT Pub. No.: WO2011/112086

PCT Pub. Date: Sep. 15, 2011

(65) Prior Publication Data

US 2013/0134869 A1 May 30, 2013

Related U.S. Application Data

(60) Provisional application No. 61/313,531, filed on Mar. 12, 2010.

(30) Foreign Application Priority Data

Mar. 12, 2010 (NL) ..... 1037800

(51) Int. Cl.
*H01J 40/06* (2006.01)
*H01J 1/34* (2006.01)

(52) U.S. Cl.
CPC .. *H01J 1/34* (2013.01); *H01J 40/06* (2013.01)
USPC ..... 313/542; 313/523

(58) Field of Classification Search
CPC ..... H01J 1/34; H01J 40/06
USPC ..... 313/542, 541, 543, 544, 532, 527, 530, 313/523, 329, 367; 252/501.1
See application file for complete search history.

(56) References Cited

U.S. PATENT DOCUMENTS 5,977,705 A 11/1999 Sinor et al.
5,982,094 A * 11/1999 Niigaki et al. ..... 313/542
(Continued)

FOREIGN PATENT DOCUMENTS

EP 0 829 898 A1 3/1998
EP 1 513 185 A1 3/2005
(Continued)

OTHER PUBLICATIONS

International Search Report from the European Patent Office for PCT/NL2011/050165 dated Jul. 5, 2011.

*Primary Examiner* — Nimeshkumar Patel
*Assistant Examiner* — Glenn Zimmerman
(74) *Attorney, Agent, or Firm* — Shumaker, Loop & Kendrick, LLP

(57) ABSTRACT

A photo cathode for use in a vacuum tube including a cathode layer, having an entrance face capable of absorbing photons impinging on the cathode layer, and an exit face for releasing electrons upon impinging of the photons, and an electron exit layer, in facing relationship with the exit face of the cathode layer for improving the releasing of the electrons, and a carbon containing layer, positioned between the exit face of the cathode layer and the electron exit layer, for bonding the electron exit layer to the cathode layer.

20 Claims, 3 Drawing Sheets

(56) References Cited

U.S. PATENT DOCUMENTS

| | | | | |
|---|---|---|---|---|
| 6,002,141 | A * | 12/1999 | Niigaki et al. | 257/10 |
| 2002/0113551 | A1 * | 8/2002 | Francke et al. | 313/542 |
| 2005/0174052 | A1 * | 8/2005 | Niigaki et al. | 313/530 |
| 2006/0138395 | A1 * | 6/2006 | Kohno et al. | 257/10 |
| 2010/0066245 | A1 * | 3/2010 | Van Spijker | 313/532 |

FOREIGN PATENT DOCUMENTS

| | | | |
|---|---|---|---|
| EP | 2 164 092 | A1 | 3/2010 |
| WO | 2009 094277 | A2 | 7/2009 |

* cited by examiner (state of the art)

PHOTO CATHODE FOR USE IN A VACUUM TUBE AS WELL AS SUCH AS VACUUM TUBE

CROSS-REFERENCE TO RELATED APPLICATIONS

This application claims priority to PCT/NL2011/050165 filed Mar. 11, 2011, which claims priority to U.S. Application No. 61/313,531 filed Mar. 12, 2010 and Dutch Patent Application No. 1037800 filed Mar. 12, 2010, the entirety of each of which is incorporated by reference herein.

TECHNICAL FIELD AND BACKGROUND

The invention relates to a photo cathode for use in a vacuum tube at least comprising a cathode layer, having an entrance face capable for absorbing photons impinging on said cathode layer, and an exit face for releasing electrons upon impinging of said photons, as well as an electron exit layer, in facing relationship with said exit face of said photo cathode layer for improving said releasing of said electrons.

The invention also relates to a vacuum tube with a photo cathode according to the invention.

Please note that in this application vacuum tube structures comprise—amongst others—sealed devices like image intensifiers and photo multipliers that incorporate elements or subassemblies like discrete dynodes and microchannel plates that use the phenomenon of secondary emission as a gain mechanism.

Such vacuum tubes are known in the art. They comprise a cathode which under the influence of incident radiation, such as light or X-rays or other elementary particles (electrons), emits electrons, like for example photo electrons, which move under the influence of an electric field towards an anode. The electrons striking the anode constitute an information signal, which signal is further processed by suitable processing means.

Electron Affinity (EA) is a physical parameter and proposes the energy a free electron will loose when it is emitted from the cathode to the vacuum. The value of the electron affinity is determined, among others, by the material properties of the cathode. Most materials have a positive electron affinity and yield a very low quantum efficiency (QE), being the amount of electrons emitted to the vacuum per incident photon. Some other materials have a negative electron affinity (NEA). In materials with a NEA the electron gains energy upon entering the vacuum, therefore the chance of being emitted to the vacuum is fairly high and the QE of the NEA cathodes is much higher than that of cathodes with a positive electron affinity. These NEA cathodes are known in that art.

As the QE is low, it can be improved by depositing an electron exit layer on the photo cathode layer, wherein the electron exit layer having a NEA. These depositions however have to be performed in ultra high vacuum and the bonding between III-V based cathode layer and the electron exit layer is based upon Van der Waals forces and therefore very weak.

Some (namely III-V based) cathodes with NEA properties and comprising an electron exit layer have a high QE, typically around 40%. The drawback of the use of an electron exit layer however is that, because of the weak bond, the electron exit layer has to be protected from chemical attacks of gasses emitted by the microchannel plate positioned inside the vacuum chamber of the vacuum tube and the phosphor screen applied on most anodes.

An other phenomenon to which the electron exit layer has to be protected is so-called ion feedback. This occurs when (negatively charged) electrons that have acquired sufficient kinetic energy in the accelerating electric field strike and ionise atoms or molecules still present in the vacuum or adsorbed at the surfaces stricken by the electrons.

Once the neutral gas atom or molecule has been positively charged by the electron impact that knocked an electron from the outer region of the atom's electron cloud, the ions are subjected to the same electric field but, due to their positive charge, will move in the opposite direction, acquiring kinetic energy and striking surfaces at the entrance side of the device.

These ion feedback impacts are quite often very noticeable and on most instances disturb or reduce the signal outputted by the device by so-called after-pulses or ion spots in the image of the device. In many of the prior art devices, special care is given to the design, the construction or the limitation in operating pressure range or operating voltages to avoid or reduce the effects of ion feedback.

As a common solution in the art, in particular in image intensifier tube devices having component surfaces made from or contain vulnerable mono-atomic negative electron affinity layers, like for example GaAs with a Cs-based surface layer, a so-called ion barrier membrane is disposed in the vacuum chamber in order to shield off those component surfaces from the stray ions. Such membrane will prevent that stray ions will permanently damage and reduce the cathode's emissive QE.

Using an ion barrier membrane however has an essential drawback. It not only blocks the feedback of stray ions, but it also considerably reduces the amount of primary electrons that can be considered to carry the signal or image information in the device towards the anode, resulting in a significantly lower emissive QE.

BRIEF SUMMARY OF THE INVENTION

It is an object of the invention to provide a photo cathode comprising an electron exit layer enabling a high emissive QE which is resistant to stray ion feedback and chemical attack from a Multi-Channel Plate (MCP) and anode. For this purpose a photo cathode according to the invention is proposed in wherein the photo cathode comprises a active cathode layer, having an entrance face capable for absorbing photons impinging on said cathode layer, and an exit face for releasing electrons upon impinging of said photons, an electron exit layer, in facing relationship with said exit face of said photo cathode layer for improving said releasing of said electrons, and a carbon containing layer, positioned between said exit face of said photo cathode layer and said electron exit layer, for bonding said electron exit layer to said photo cathode layer.

A thin carbon containing layer is used to bond the electron exit layer to the photo cathode layer. This results in a very strong bonding of the electron exit layer to the photo cathode layer. Because the layer is thin and the carbon has advantageous material characteristics electrons are able to tunnel through the layer and are emitted to the vacuum by the electron exit layer. Because the electron exit layer has a strong bond, the cathode does not need a protecting ion barrier membrane and a longer life time and better emissive QE of the cathode is achieved.

Furthermore the electron exit layer can exhibit negative electron affinity (NEA) thereby increasing the chance that electrons are emitted to the vacuum, resulting in a higher QE of the cathode.

More specifically the carbon containing layer is oxidized.

In a specific embodiment of the invention the carbon containing layer can be composed of a mono-crystalline diamond containing layer, a poly-crystalline diamond containing layer, a coating of nano diamond particles containing layer or of at least one atomic layer of carbon (i.e. Graphene).

In yet another embodiment of the invention the photo cathode layer of the photo cathode is an III-V type photo cathode layer.

In a further embodiment of the invention the electron exit layer contains at least an alkali metal.

More specifically the alkali metal of the electron exit layer is cesium or rubidium.

In an other embodiment of the invention the photo cathode layer of the photo cathode is an alkali metal photo cathode layer.

In yet another embodiment of the invention the entrance face and exit face are located at the same side of the photo cathode layer.

In an other embodiment of the invention the photo cathode further comprises an opaque carrier layer mounted to the side opposite of the side where the entrance and exit face of the photo cathode layer are located.

In yet another embodiment of the invention the entrance face and the exit face are located at opposite sides of the photo cathode layer.

Also embodiments of a vacuum tube with such a photo cathode to be used as an image intensifier tube or photo multiplier tube are advantageous over the prior art devices.

BRIEF DESCRIPTION OF THE DRAWINGS

The invention will be explained in greater detail below with reference to the appended drawing, which shows in.

DETAILED DESCRIPTION OF THE INVENTION

Figure 1:
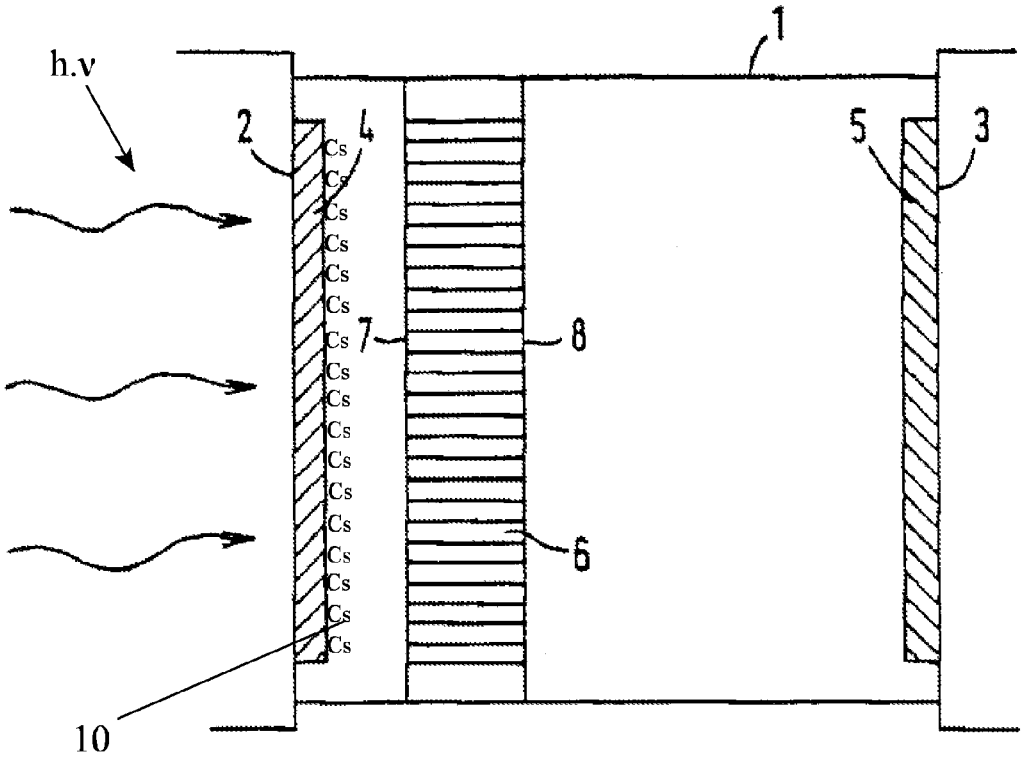
FIG. 1 discloses a vacuum tube provided with a photo cathode according to the state of the art.

For the sake of clarity in the following detailed description all like parts are denoted with the same reference numerals.

FIG. 1 shows schematically, in cross section, an example of an vacuum tube, for example an image intensifier. The image intensifier is formed in a tubular housing 1 having an entrance window 2 and an exit window 3. The tubular housing can be made of glass, as can the photo cathode layer 4 and the anode layer 5. Inside the tubular housing 1 an ultra-high vacuum consists.

On the entrance face of the entrance window photons (h.v) enter the tubular housing 1 and are absorbed by the photo cathode layer 4. The photo cathode layer 4 creates electrons upon absorbing of the impinging photons, which electrons are released towards the vacuum inside the tubular housing 1. The electrons that are released towards the vacuum are moving towards the entrance face 7 of a channel plate 6. In some cases the photo cathode layer 4 is placed directly on the channel plate 6. Such variants are known and are therefor not shown in FIG. 1 or in greater detail. Known types of channel plates 6 are micro-channel plates (MCP). At the micro-channel plate the electrons are being multiplied (secondary emission) and most of the electrons are released at the exit face 8 of the channel plate 6 into the vacuum towards the anode 5. The anode 5 is placed on a detection/exit window 3 which can be made of glass and is also often made of an optical fibre plate, as a scintillating screen, or as a pixilated array of elements (such as a semiconductor active pixel array).

One of the most important aspects of the image intensifier is the quantum efficiency (QE) which is the number of electrons that are emitted to the vacuum per incident photon.

When the photons are absorbed by the photo cathode layer 4 the optical properties of the entrance window 2 and the photo cathode layer 4 and its thickness itself determine how these photons are absorbed. Thick photo cathode layers 4 have better absorption characteristics and narrow photo cathode layers 4 result in a better electron transport. Upon absorbing the photons the cathode emits electrons. Single photo cathode layers 4 have a relative low QE because not all electrons are emitted to the vacuum. Electrons can recombine with the hole inside the cathode or can be trapped at the surface because they have to little kinetic energy to be emitted to the vacuum. The material properties and crystal quality of the photo cathode and the photo cathode layer 4 determine the carrier life time and diffusion length of the carrier. A good crystal quality with little grain boundaries and small number of defects is needed to achieve long carrier lifetime and diffusion length, thereby increasing the chance an electron is being emitted to the vacuum without being recombined first.

The Electron Affinity (EA) is of great importance for the emission of the electrons into the vacuum. The EA is the energy that a free electron will loose when it is emitted from the bulk to the vacuum. The value of the EA is determined by the layers comprised by the photo cathode. For most materials the EA is positive. The electrons therefore need sufficient energy to overcome the energy threshold to be emitted to the vacuum. Most photo cathode layers with a positive EA yield a low QE. Some other materials, or combinations of material layers of the photo cathode have a Negative Electron Affinity (NEA). Electrons therefore gain energy when being emitted to the vacuum when they are near that vacuum. The chance of being emitted is therefore fairly higher, resulting in a significant higher QE. The use of alkali metals such as, but not limited to, Cesium (Cs), Rubidium (Rb), Potassium (Na) or Sodium (K), mostly in the form of $Cs_2O$ or CsF in combination with Cesium, result in a NEA and are well known in the art. Electron exit layers are the layers where these materials are used in order to significantly increase the QE.

In FIG. 1 an illustration of an electron exit layer 10, in this case a Cs containing layer, is shown. Other types of electron exit layers are know in the art and are therefor not shown in FIG. 1 or in greater detail.

These electron exit layers are used on three types of cathode layers, being metallic photo cathodes like Platinum, Gold and Silver cathodes, alkali metal based photo cathodes, usually a combination of Na, K and Antimony Sb, and III-V type photo cathodes like GaAs, AlGaAs, InGaAs, GaN and more.

The metallic photo cathodes are robust but have a low QE.

The alkali based photo cathodes are commonly used and the electron exit layer is commonly based on Cs. The Cs containing electron exit layer has a strong chemical bond to the cathode layer, which cathode layer has limited crystal quality, resulting in a short carrier diffusion length. Therefore thicknesses are usually limited below 200 nm resulting in limited optical absorption and therefore in a relative low QE.

The III-V type photo cathodes are made from materials which are widely used in for example the semi conductor industry. The thickness of the cathode and the doping level can be well controlled. Because of the good crystal quality the value of the carrier lifetime and diffusion length are large. The QE however is very low and in order to increase the QE the use of a electron exit layer is needed. Common electron exit layers used in the III-V type photo cathodes are $Cs_2O$ or CsF mostly in combination with metallic Cs. The use of the electron exit layer results in a significant increase in QE.

But the deposition of this electron exit layer however has to be preformed in ultra high vacuum and the bonding between the photo cathode layer and electron exit layer is purely based on van der Waals forces. Because the bonding is based on Van der Waals forces the bonding is very weak and has to be protected against chemical attack and stray ion feedback. Solutions known in the art to protect the electron exit layer are the use of an ion barrier. These ion barriers however protect the electron exit layer from chemical gasses and stray ion feedback but result in trapped electrons at that barrier therefore the QE significantly lowers.

Figure 2:
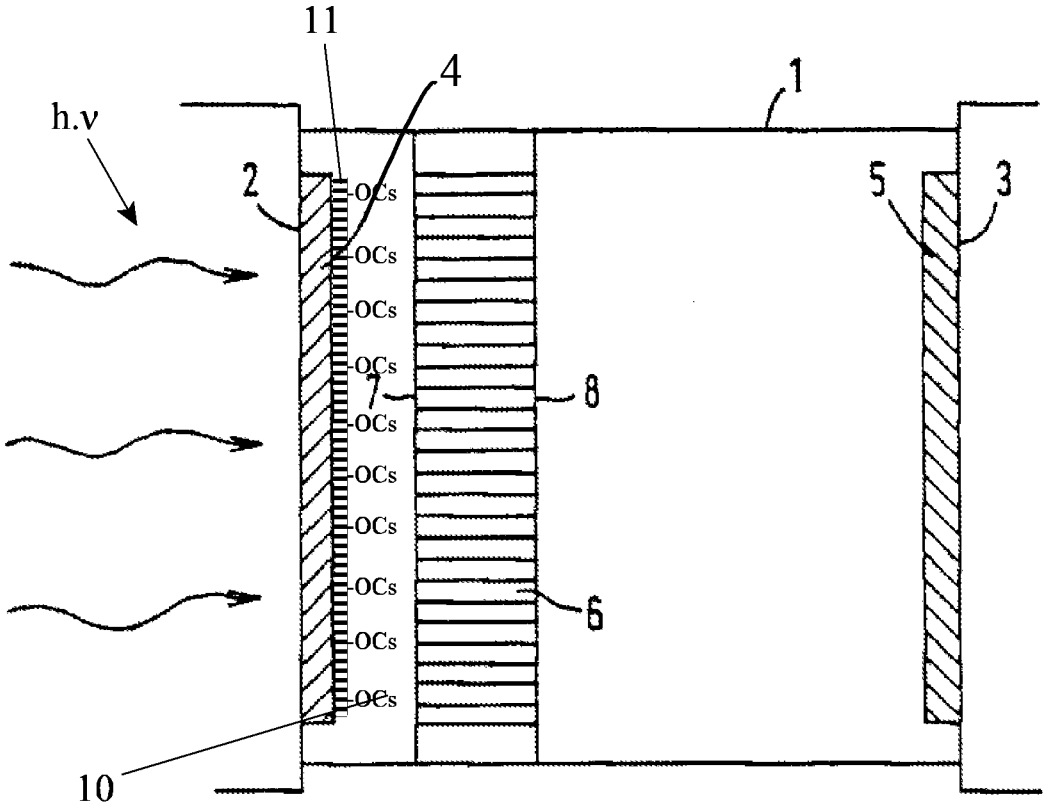
FIG. 2 discloses an embodiment of a vacuum tube with a photo cathode according to the invention.

FIG. 2 shows also a vacuum tube, but this time with a bonding layer 11 between the photo cathode layer 4 and the electron exit layer 10. This bonding layer is containing carbon which results in a very strong bonding of the electron exit layer 10 to the cathode layer 4. Because in a particular embodiment the carbon containing layer 11 is cesiated it has a NEA resulting in a higher QE. Because the bonding is a strong chemical bonding, not just based upon van der Waals forces, the electron exit layer is much better resistant to chemical gasses and to stray ion feedback. Another important advantage is that because of the strong bond the bonding can be exposed to ambient environment without losing the NEA. The process of creating a vacuum tube is therefore simplified, not at all stages the entrance window, comprising the photo cathode layer and the strong bonded electron exit layer have to be maintained in ultra high vacuum.

Furthermore in an other embodiment the bonding layer 11 can be further improved to create an even stronger bond between the electron exit layer 10 and the photo cathode layer 4 by oxidizing the bonding layer 11, which is shown in FIG. 2.

Examples of, but not limited to, carbon containing layers to be used as a bonding layer 11 for the electron exit layer 10 on the photo cathode layer 4 are the use of mono-crystalline diamond containing layers, poly-crystalline diamond containing layers, coating of nano diamond particles layers, diamond like carbon (DLC) containing layers, and graphene containing layers.

Figure 3:
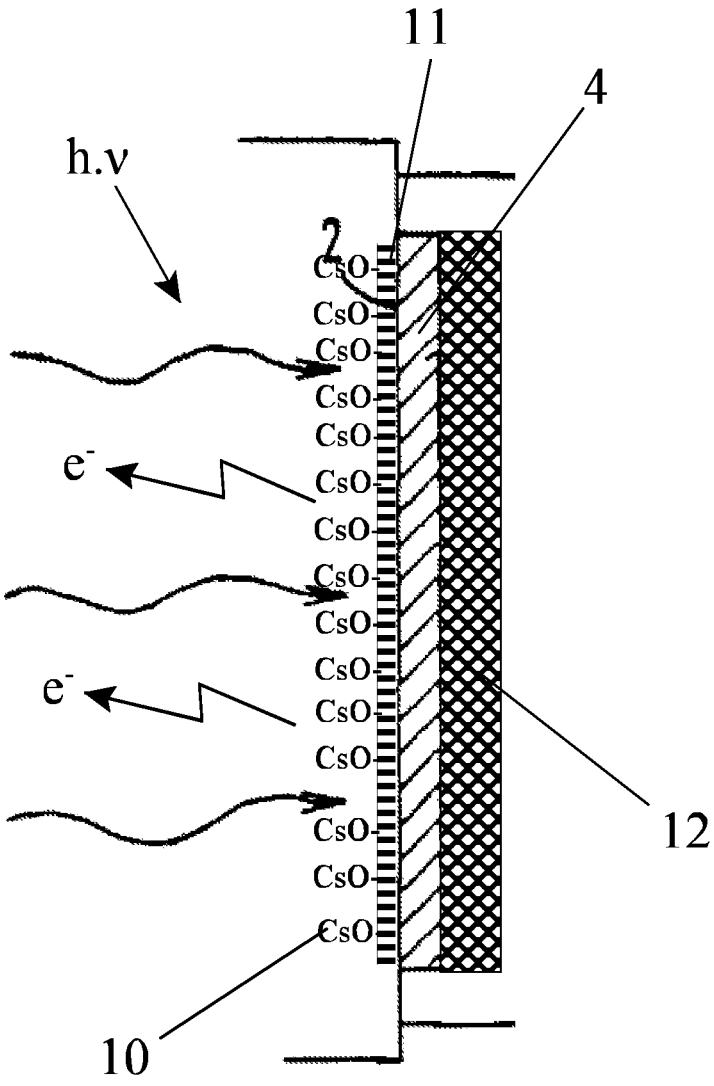
FIG. 3 discloses another embodiment of a photo cathode according to the invention.

FIG. 3 discloses another embodiment of a photo cathode according to the invention. In this embodiment the photo cathode comprises an entrance and an exit face, which are positioned or located at the same side of the photo cathode layer. Electrons are emitted from the same side (the exit face) as the side (the entrance face) on which the photons impinge. On the opposite side an opaque carrier 12 is mounted to the photo cathode layer, serving as a reflective barrier for the electrons being released in the cathode layer material.

The invention claimed is:

1. A photo cathode for use in a vacuum tube, comprising:

a cathode layer, having an entrance face capable of absorbing photons impinging on the cathode layer, and an exit face for releasing electrons upon impinging of the photons;

an electron exit layer, in facing relationship with the exit face of the cathode layer for improving the releasing of the electrons; and a carbon containing layer, positioned between the exit face of the cathode layer and the electron exit layer, for bonding the electron exit layer to the cathode layer.

2. The photo cathode according to claim 1, wherein the electron exit layer exhibits negative electron affinity (NEA) properties.

3. The photo cathode according to claim 1, wherein the carbon containing layer is oxidized.

4. The photo cathode according to claim 1, wherein the carbon containing layer is a mono-crystalline diamond containing layer.

5. The photo cathode according to claim 1, wherein the carbon containing layer is a poly-crystalline diamond containing layer.

6. The photo cathode according to claim 1, wherein the carbon containing layer is a coating of nano diamond particles containing layer.

7. The photo cathode according to claim 1, wherein the carbon containing layer includes at least one layer of carbon having a graphene-like structure.

8. The photo cathode according to claim 1, wherein the cathode layer is a II-V type semiconductor.

9. The photo cathode according to claim 1, wherein the electron exit layer contains at least an alkali metal.

10. The photo cathode according to claim 9, wherein the electron exit layer contains at least cesium.

11. The photo cathode according to claim 9, wherein the electron exit layer contains at least rubidium.

12. The photo cathode according to claim 1, wherein the cathode contains at least an alkali metal.

13. The photo cathode according to claim 12, wherein the cathode contains at least cesium.

14. The photo cathode according to claim 1, wherein the entrance face and the exit face are located at the same side of the cathode layer.

15. The photo cathode according to claim 14, wherein the photo cathode further comprises an opaque carrier layer mounted to the side of the cathode layer opposite of the side where the entrance and exit face are located.

16. The photo cathode according to claim 1, wherein the entrance face and the exit face are located at opposite sides of the cathode layer.

17. A vacuum tube having a photo cathode according to claim 1.

18. The vacuum tube according to claim 17, wherein the vacuum tube is constructed as an image intensifier tube.

19. The vacuum tube according to claim 17, wherein the vacuum tube is constructed as a photo multiplier tube.

20. The photo cathode according to claim 1, wherein the carbon containing layer is oxidized and is a mono-crystalline diamond containing layer, and the electron exit layer contains at least an alkali metal in which the alkali metal is covalently bonded to the carbon containing layer.

* * * * *